US006471067B1

(12) United States Patent
Lancaster

(10) Patent No.: US 6,471,067 B1
(45) Date of Patent: Oct. 29, 2002

(54) METHOD AND APPARATUS FOR CUSHIONING AN ARTICLE

(75) Inventor: Robert Charles Lancaster, Carmel, IN (US)

(73) Assignee: Thomson Licensing, S.A., Boulogne-Billancourt (FR)

( * ) Notice: Subject to any disclaimer, the term of this patent is extended or adjusted under 35 U.S.C. 154(b) by 15 days.

(21) Appl. No.: 09/590,911

(22) Filed: Jun. 9, 2000

(51) Int. Cl.[7] ..... B65D 81/02
(52) U.S. Cl. ..... 206/594; 206/523; 206/586
(58) Field of Search ..... 206/521, 523, 206/524, 320, 576, 586, 591, 592, 594; 428/131, 134, 138

(56) References Cited

U.S. PATENT DOCUMENTS

| | | | | |
|---|---|---|---|---|
| 3,811,562 A | * | 5/1974 | Smith | 206/523 |
| 3,938,661 A | | 2/1976 | Carmody | |
| 4,287,265 A | * | 9/1981 | McKnight | 206/586 |
| 4,613,042 A | * | 9/1986 | Aeschliman | 206/419 |
| 5,385,232 A | | 1/1995 | Foos et al. | |
| 5,678,692 A | * | 10/1997 | Gratz | 206/592 |
| 5,695,057 A | * | 12/1997 | Sullivan | 206/418 |
| 5,899,331 A | * | 5/1999 | Warren, Jr. | 206/443 |
| 6,274,217 B1 | * | 8/2001 | Kim | 206/523 |

FOREIGN PATENT DOCUMENTS

| | | |
|---|---|---|
| DE | 1814978 | 7/1960 |
| DE | 8714602 | 3/1989 |
| DE | 4039572 | 8/1991 |
| DE | 4132650 | 4/1993 |
| DE | 19628660 | 2/1997 |

OTHER PUBLICATIONS

Search Report for German Patent Appn. No. 101 24 470.3 dated Jan. 11, 2002.

* cited by examiner

*Primary Examiner*—Luan K. Bui
(74) *Attorney, Agent, or Firm*—Joseph S. Tripoli; Robert D. Shedd

(57) ABSTRACT

An apparatus and method for protecting an article during shipment is provided. In one embodiment, a packaging apparatus includes a formed body comprised having a first resiliency. The formed body has a plurality of recesses disposed on a first side of the formed body. An insert having a resiliency greater than the resiliency of the formed body is disposed in at least one of the recesses disposed in the formed replace. In another embodiment, a method for packing an article includes inserting an insert of resilient material into selected recesses in a cushioning material in locations where additional protection of a packaged device is needed.

5 Claims, 3 Drawing Sheets

METHOD AND APPARATUS FOR CUSHIONING AN ARTICLE

BACKGROUND OF THE DISCLOSURE

1. Field of Invention

The present invention relates generally to a method and apparatus for cushioning an article. More specifically, the invention relates to a method and apparatus for cushioning an article to prevent damage during transport (i.e., shipping) of the article.

2. Description of the Background Art

Many articles are packaged with cushioning material to protect the articles from damage during shipping. Generally, cushioning material may be in the form of loose material or an insert positioned between the article and a shipping carton. The cushioning material prevents the article from moving during shipment, while providing a measure of impact protection from rough handling of the shipping container (e.g., a corrugated box). Examples of an article commonly shipped in this fashion include electronic devices, such as computers, stereos, television receivers, video players and the like.

A cushioning material commonly used to form shipping inserts is wood pulp fiber. Wood pulp fiber is desirable because it is light, easily molded, inexpensive and can be recycled. However, shipping inserts made from pulp fiber material have some disadvantageous aspects. For example, pulp fiber generally may not adequately protect electronic devices from some impacts commonly experienced during shipping. When shipping electronic devices, the shipping insert must have enough resiliency such that handling of the shipping container does not cause the insert to be permanently deformed. If the insert does not have enough resiliency to substantially recover to its original geometry after impact, the device may shift or move within the shipping container, thus increasing the probability of damage to the device.

Additionally, wood pulp material is susceptible to moisture, either from direct contact with fluids or humidity present in the environment. Wood pulp that absorbs moisture may lose its structural integrity and allow the insert to change shape (e.g., soften and collapse). Once softened, the insert may no longer restrain the electronic device, thereby allowing movement of the device within the carton, again increasing the probability of damage.

Therefore, there is a need in the art for a packaging material for protecting a device during shipping after once being impacted.

SUMMARY OF INVENTION

The present invention generally provides a packaging apparatus for the protection of an article during shipment. In one embodiment, a packaging apparatus includes a formed body having a first resiliency. The formed body has a plurality of recesses disposed on a first side of the formed body. An insert having a resiliency greater than the resiliency of the formed body is disposed in at least one of the recesses disposed in the formed body.

In another aspect of the invention, a method for packing an article is provided. In one embodiment, a method for packing an article includes determining one or more concentrated weight areas of the article; selecting one or more recesses formed on a body of cushioning material that correspond to the determined concentrated weight areas; and providing a material more resilient than the cushioning material into the selected recesses.

BRIEF DESCRIPTION OF DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION OF INVENTION

Figure 1:
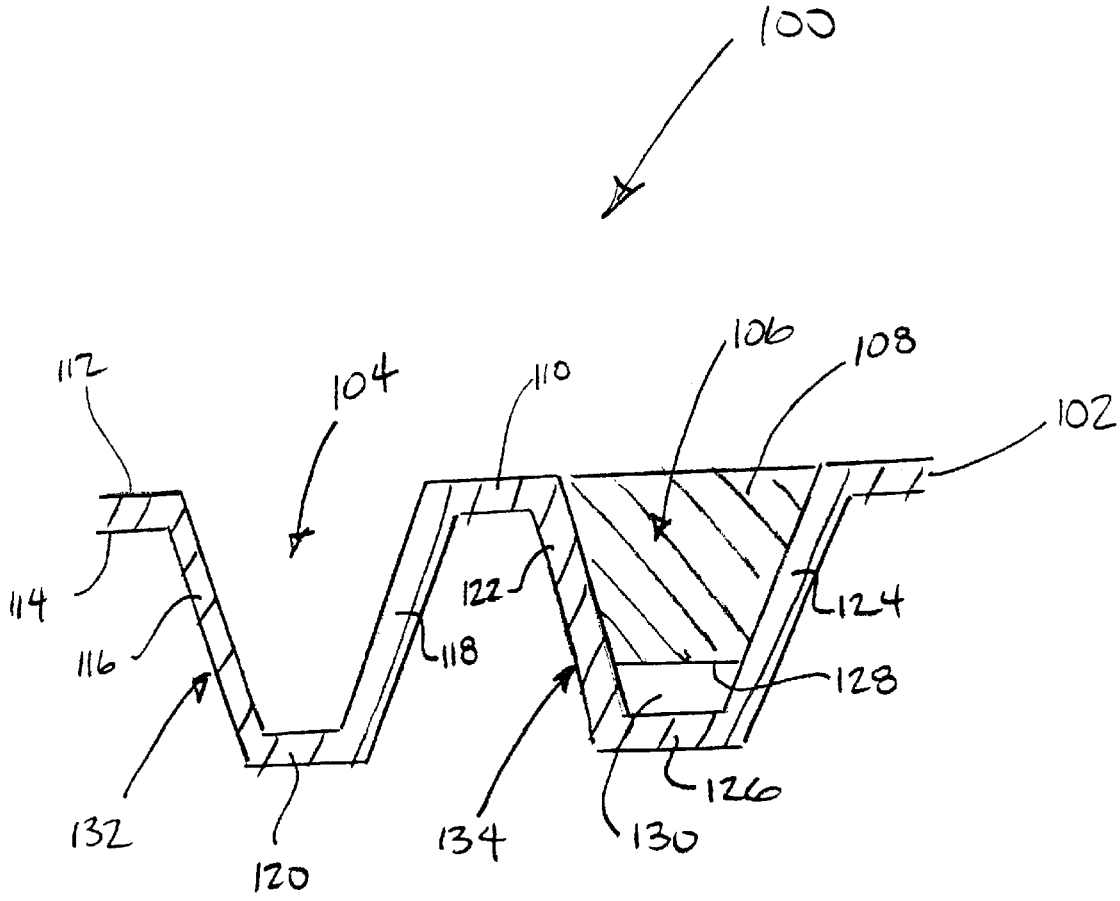
FIG. 1 depicts an apparatus for protecting a device during transportation.

FIG. 1 depicts an apparatus 100 for protecting an article during shipping. Generally, the apparatus 100 includes a body 102 of cushioning material having at least a first recess 104 and a second recess 106 formed on a first surface 112 of the body 102. An insert 108 of resilient material is disposed in at least the second recess 106.

More specifically, the body 102 includes a base 110 having a first surface 112 and a second surface 114. A first projecting member 132 and a second projecting member 134 extend from the first surface 112 of the base 110. In one embodiment, the first projecting member 132 includes a first wall 116 and at least a second wall 118 coupled by a first connecting member 120. The first connecting member 120, the first wall 116 and the second wall 118 define the first recess 104 therebetween. The first recess 104, disposed on the second surface 114 of the base 110, may be open between the walls 116, 118 or enclosed by additional walls. Alternately, the first projection 132 may be formed within the first surface 112 as a unitary member or other geometry integrally incorporating the walls 116, 118 and first connecting member 120 into a single member or shape.

The second projection 134 includes a third wall 122 and at least a fourth wall 124 coupled by a second connecting member 126. The second connecting member 126, the third wall 122 and the fourth wall 124 define the second recess 106 therebetween. The second recess 106, which is disposed on the second side 106 of the base 110, may be open between the walls 122, 124 or enclosed by additional walls. Alternately, the second projection 134 may be formed within the first surface 112 as a depression or other geometry without the use of the walls 122, 124 and second connecting member 126. The body 102 may include additional recesses disposed on the first surface 112 of the base 110, or on the second surface 114 of the base 110.

The body 102 is comprised of a cushioning material that is used for protective packaging. The cushioning material generally is molded, formed, fabricated, shaped or otherwise forms a shape that is adapted to maintain an article in a spaced apart relation to a packing container. Examples of the cushioning material are wood pulp fiber, paperboard, corrugated paper, molded plastic and expanded plastic such as expanded polystyrene foam. In one embodiment, the body 102 is comprised of molded wood pulp.

The insert 108 is generally comprised of a material having a resiliency greater than the cushioning material. For example, the insert 108, when utilized with a molded pulp body 102, may be comprised of an elastomer or foamed polymer such as polyurethane. Generally, the insert material is able to recover to substantially its original geometry after an impact typically experienced during shipping or handling. In this manner, the efficiency of the apparatus for protecting an article is maintained such that subsequent impacts may be cushioned.

In one embodiment, the insert 108 is disposed in the second recess 106. The insert 108 may be placed or dispensed in the second recess 106 such that the insert 108 adheres to the body 102 upon curing. Alternately, the insert 108 may be adhered to the body 102 using conventional adhesives. Additional inserts 108 may be disposed in other recesses.

Alternatively, the insert 108 may be loose or releasably disposed in the second recess 106. The insert 108 may be adhered to the body 102 using a releasable adhesive, or the insert 108 may bond with the body 102 such that it is easily removed so that the insert 108 and body 102 may be separated for recycling. Alternatively, the insert 108 and body 102 may include a "snap-fit" so the insert 108 engages the body 102 in a manner that prevents separation of the insert 108 and body 102 without the application of an external force, such as provided by a person or automated equipment directed to perform this task. Loose inserts 108 generally fall free of the body 102 when not confined by a packing container (not shown).

Optionally, the insert 108 may include a surface 128 that is in a spaced-apart relation to the second connecting member 126. The surface 128 and the second connecting member 126 define a gap 130 that traps a pocket of air. The air pocket trapped in the gap 130 provides an additional measure of impact resistance to the apparatus 100. Optionally, the pocket or trapped air may be vented through a small passage that restricts rapid air movement into and out of the pocket.

Figure 2:
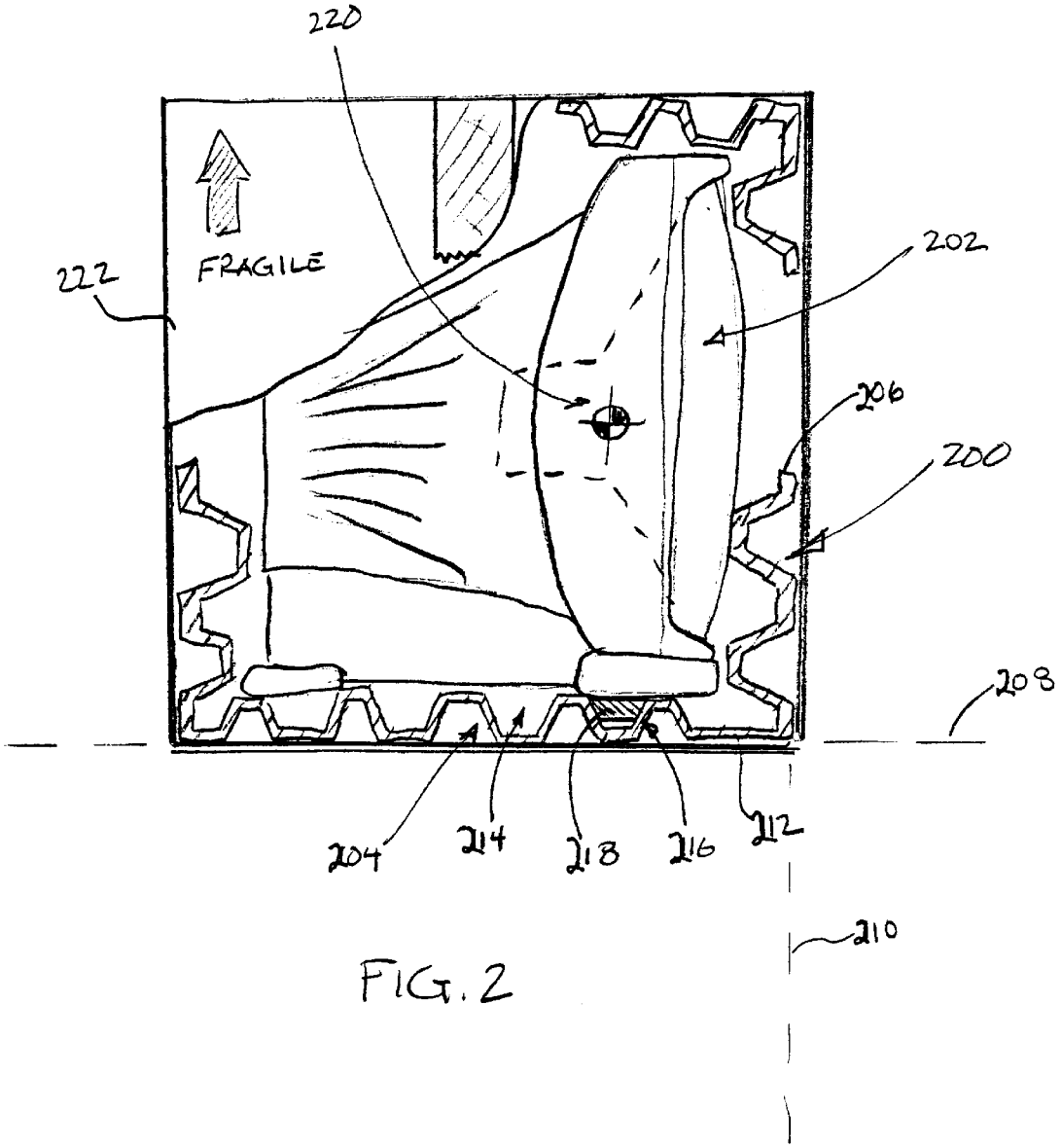
FIG. 2 depicts a shipping container utilizing another embodiment of a protective apparatus.

FIG. 2 depicts a shipping container 222 utilizing another embodiment of an apparatus 200 for protecting an article 202, for example, an electronic device such as a television receiver. The apparatus 200 is substantially similar to the apparatus 100 described above with reference to FIG. 1. The apparatus 200 includes a first portion 204 and at least a second portion 206. The first portion 204 is substantially orientated in a first plane 208 and at the second portion 206 is substantially orientated in a second plane 210.

The first portion 204 includes a body 212 having a first recess 214 and at least a second recess 216. At least the second recess 216 includes an insert 218 of resilient material disposed therein. In the preferred embodiment, the position of the insert 218 is selected to support the heavier portions of the article 202 to be protected during shipping. For example, if the article 202 is a television receiver, an area of weight concentration may be located under the picture tube 220. The body 212 is formed such that the adequate recesses (and optionally other structural elements formed therein) maintain the article 202 in a predetermined spaced-apart relation to the shipping container 222 (e.g., a corrugated or other shipping carton).

In one embodiment, the first portion 204 is disposed beneath the article 202. The second recess 216 is positioned below the picture tube 220 of the article 202 (e.g., television receiver). The insert 218 disposed within the second recess 216 prevents the body 212 from being deformed by the weight of the picture tube 220, and thus maintaining the article 202 in the predetermined position throughout the shipping process until unpacked by the end user.

Optionally, additional recesses may be located on the first portion 204. The additional recesses may be on the first or the second side of the body 212. Some or all of the additional recesses may contain additional inserts 218 as desired to support the article 202.

The second portion 206 of the body 212 generally contains a plurality of recesses that separate the article 202 from the walls of the shipping container 222. Some or all of the recesses may contain inserts 218 to prevent deformation of the second portion 206 when subjected to lateral forces during shipping and handling.

Figure 3:
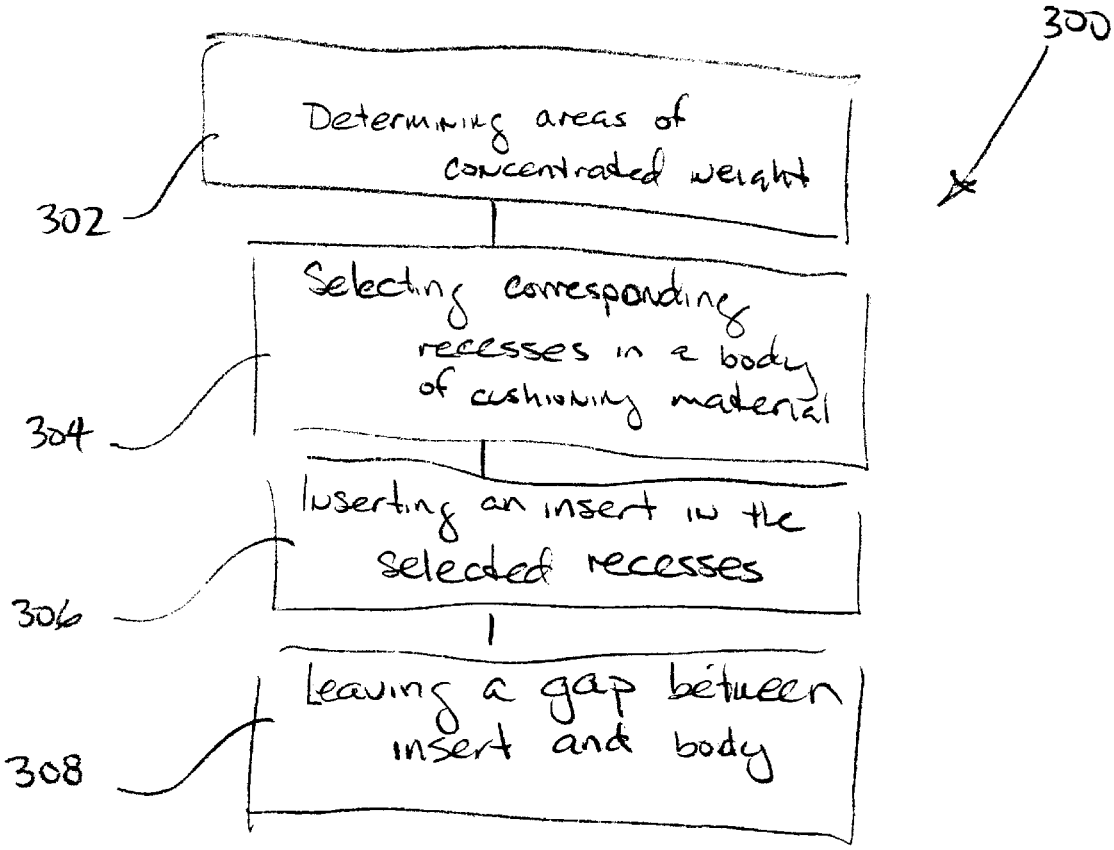
FIG. 3 is a block diagram depicting a method for protecting a device during shipping.

FIG. 3 depicts a flow diagram of the method 300 of packaging according to the present invention. Specifically, at step 302, the areas of concentrated weight for the article to be packaged are determined. The method 300 then proceeds to step 304.

At step 304, recesses in a body of cushioning material corresponding to the areas of concentrated weight are selected. The method 300 then proceeds to step 306.

At step 306, resilient material is provided into or inserted into each of the recesses selected at step 304. As previously discussed, the resilient material provides selective cushioning (i.e., a localized area of resilient packaging protection) suitable for adapting the packaging of the present invention to the weight distribution of the article to be shipped or transported. The method 300 then proceeds to optional step 308.

At optional step 308, the inserted or provided resilient material is arranged in a manner insuring that a gap between resilient material and the body of the cushioning material is provided, thereby creating a pocket of trapped air. The pocket of trapped air further assists in cushioning the transported or shipped article. In other embodiments, the method 300 may contain additional steps such as removing the inserts or inserting other inserts in non-selected recesses.

The invention has been primarily described within the context of a formed body having an insert. However, it will be appreciated by those skilled in the art that the invention has general applicability to any shipping container utilizing materials that have been selected for their relative resiliency parameters or other parameters.

Additionally, it is within the contemplation of the present invention that the shapes of the recesses and inserts can be any other appropriate shape, e.g., semi-circular, etc. Further, the shapes of the respective recesses and inserts can be other than complementary.

Although the teachings of the present invention have been shown and described in detail herein, those skilled in the art can readily devise other varied embodiments that still incorporate the teachings and do not depart from the spirit of the invention.

What is claimed is:

1. A shipping carton for an electronic device, comprising:

a shipping container;

an electronic device disposed within said shipping container;

at least one body comprised of a molded pulp disposed between at least a portion of the shipping container and the electronic device;

at least a first recess formed in the body;

at least a second recess formed in the body;

an insert comprised of a polymer having a resiliency greater than a resiliency of molded pulp;

the insert being disposed in the second recess.

2. A shipping carton as recited in claim 1, wherein:

said body having a horizontal position in said container selected to support the heavier portions of said electronic device to be protected during shipping.

3. A shipping carton as recited in claim 1, wherein:

said body having a vertical position in said container selected to provide lateral support of said electronic device to be protected during shipping.

4. A shipping carton as recited in claim 1, wherein:

said body having a horizontal position in said container selected to support the heavier portions of said electronic device to be protected during shipping; and said body having a vertical position in said container selected to provide lateral support of said electronic device to be protected during shipping.

5. A shipping carton for an electronic device, comprising:

a shipping container;

an electronic device disposed within said shipping container;

a body having a first portion comprised of a molded pulp disposed horizontally between at least a portion of the shipping container and the electronic device, said first portion of said body having plural recesses formed therein;

selected ones of said plural recesses of said first portion of said body containing an insert comprised of a polymer having a resiliency greater than a resiliency of molded pulp;

a second portion of said body comprised of said molded pulp disposed vertically between at least a portion of the shipping container and the electronic device; said second portion of said body having plural recesses formed therein;

selected ones of said plural recesses of said second portion of said body containing an insert comprised of said polymer having a resiliency greater than said resiliency of molded pulp.

* * * * *